US005143302A

United States Patent [19]

Sakuma

[11] Patent Number: 5,143,302

[45] Date of Patent: Sep. 1, 1992

[54] AIRLESS SPRAY NOZZLE

[75] Inventor: Hideo Sakuma, Hatano, Japan

[73] Assignee: Shimon Kabushiki Kaisha, Tokyo, Japan

[21] Appl. No.: 655,073

[22] Filed: Feb. 14, 1991

[30] Foreign Application Priority Data

Feb. 15, 1990 [JP] Japan ..... 2-34194

[51] Int. Cl.[5] ..... B05B 1/04

[52] U.S. Cl. ..... 239/599; 239/DIG. 14

[58] Field of Search ..... 239/592, 594, 595, 597, 239/599, 568, DIG. 14

[56] References Cited

U.S. PATENT DOCUMENTS

| | | | |
|---|---|---|---|
| 2,683,627 | 7/1954 | Wahlin | 239/597 |
| 2,722,458 | 11/1955 | Wahlin | 239/597 |
| 3,659,787 | 5/1972 | Ito | 239/599 |
| 4,905,911 | 3/1990 | Sakuma | 239/599 |
| 4,988,043 | 1/1991 | Lechler | 239/597 |

FOREIGN PATENT DOCUMENTS

| | | | |
|---|---|---|---|
| 1147436 | 3/1985 | U.S.S.R. | 239/599 |
| 1212596 | 2/1986 | U.S.S.R. | 239/599 |

*Primary Examiner*—Andres Kashnikow
*Assistant Examiner*—Christopher G. Trainor
*Attorney, Agent, or Firm*—Pearne, Gordon, McCoy & Granger

[57] ABSTRACT

An airless spray nozzle which is capable of spraying paint of high viscosity as well as that of low viscosity while effectively preventing generation of tailing. A pair of stops formed between a substantially hemispherical depression of a front nozzle section and a through-hole of a rear nozzle section, a pair of main slants formed on the inner surface of the rear nozzle section defining the through-hole, a pair of first auxiliary slants and a pair of the second auxiliary slants each successively formed on the inner surface of the front nozzle section defining the depression cooperate to one another to positively spray paint of increased viscosity under a relatively low pressure without generating any tailing.

4 Claims, 3 Drawing Sheets

AIRLESS SPRAY NOZZLE

BACKGROUND OF THE INVENTION

This invention relates to an airless spray nozzle adapted to spray a coating material such as paint by means of only a liquid pressure without using compressed air, and more particularly to an airless spray nozzle suitable for spraying a coating material of high viscosity without generating any tailing.

Conventionally, various kinds of airless spray nozzles have been proposed for the purpose of preventing generation of tailing on both sides of an elongated spray pattern as much as possible. For example, an airless spray nozzle for spraying a coating material of low viscosity such as melamine resin paint without using compressed air is disclosed in U.S. Pat. No. 3,659,787 corresponding to Japanese Patent Publication No. 4799/1972 and U.S. Pat. No. 4,905,911 corresponding to Japanese Patent Application Laid-Open Publication No. 178867/1988. The airless spray nozzle disclosed is generally constructed in such a manner that a substantially hemi-spherical depression or cavity opens rearwardly and has a groove provided across the depression to form a lenticular orificetype injection hole and a through-hole arranged rearward of the depression and connected to a paint feed source.

The spray nozzle disclosed in U.S. Pat. No. 3,659,787 is formed with an annular step at the boundary between the hemi-spherical depression and through-hole which provide a flow passage for paint in cooperation with each other. The step thus arranged would function to generate turbulence in the flow of paint at the rear of the injection hole to equalize the pressure or velocity of paint at the rear of the injection hole or the flow velocity of paint, to thereby prevent generation of tailing.

The spray nozzle disclosed in U.S. Pat. No. 4,905,911 is designed to prevent generation of tailing even when a paint injection pressure or a pressure applied to paint is reduced as compared with that in the spray nozzle taught in U.S. Pat. No. 3,659,787. The nozzle of U.S. Pat. No. 4,905,911 is provided on a part of the inner peripheral surface thereof which defines the through-hole with a pair of straight guides or main slants arranged opposite to each other, through which the through-hole is partially connected to the depression in a manner to be smoothly contiguous thereto. Also, the remaining part of the boundary between the through-hole and the depression other than the above-described part smoothly contiguous to the main slants is provided with a pair of steps which are defined between the opposite main slants and through which the through-hole and depression are discontinuously connected to each other. The main slants are positioned so as to be aligned with both end sides of the injection hole. It would be considered that the arrangement of such main slants causes the flow of paint along the main slants into the depression (straight flow of paint) to collide with the flow of paint deflected by the steps (deflection flow of paint), to thereby produce significantly increased turbulence at the rear of the injection hole.

Recently, the demand for an airless spray nozzle which permits resin paint of viscosity as high as 10 poise to be sprayed without generating tailing has increased. Unfortunately, it was found that the conventional airless spray nozzle described above fails to prevent tailing when a paint injection pressure is limited to a low level. This is for the reason that the conventional airless spray nozzle is designed to prevent tailing in the injection of paint of viscosity as low as Ford Cup 4 corresponding to 3 poise or less such as melamine resin paint.

SUMMARY OF THE INVENTION

The present invention has been made in view of the foregoing disadvantage of the prior art.

Accordingly, it is an object of the present invention to provide an airless spray nozzle which is capable of spraying paint of high viscosity as well as that of low viscosity while effectively preventing generation of tailing.

It is another object of the present invention to provide an airless spray nozzle which is capable of permitting a groove for providing a lip-like or lenticular orifice-type injection nozzle to be readily formed.

It is a further object of the present invention to provide an air less spray nozzle which is capable of being easily manufactured.

In accordance with the present invention, an airless spray nozzle is provided. The airless spray nozzle includes a front nozzle section formed therein with a substantially hemi-spherical depression in a manner to be rearwardly open and at the front portion thereof with a groove in a manner to intersect the depression to form a lip-like lenticular orifice-type injection port, a rear nozzle section formed integral with the front nozzle section and provided therein with a through-hole in a manner to be coaxial with the depression and communicate with the depression, and a pair of steps arranged at the boundary between the through-hole of the rear nozzle section and the depression of the front nozzle section in a manner to be opposite to each other and perpendicular to a line defined by connecting both ends of the injection port. The steps each are arranged so as to extend outward of the depression in the radial direction of the depression. The airless spray nozzle also includes a pair of main slants formed on the inner surface of the rear nozzle section defining the through-hole in a manner to be opposite to each other and positioned on both end sides of the orifice-type injection port. The main slants are arranged so as to slope forwardly and gradually approach the axis of the through-hole. Also, the airless spray nozzle includes a pair of first auxiliary slants formed on the inner surface of the front nozzle section defining the depression or the inner surface of the nozzle body defining both depression and through-hole or extending over both the front nozzle section and rear nozzle section in a manner to be opposite to each other and contiguous to the main slants. The first auxiliary slants each are slantingly arranged so as to also slope forwardly and gradually approach the axis of the depression at an inclination angle different from that of the main slants. Further, the airless spray nozzle includes a pair of second auxiliary slants formed on the inner surface of the front nozzle section defining the depression in a manner to be positioned forward of the first auxiliary slants and contiguous thereto. The second auxiliary slants each are slantingly arranged so as to slope forwardly and gradually approach the axis of the depression at an inclination angle larger than that of the first auxiliary slants. The groove has a bottom arranged in a manner to be aligned with the front end of each of the first auxiliary slants or in proximity thereto.

The inclination angle and axial length of each of the first and second auxiliary slants are determined depending upon the characteristics of paint to be sprayed such as viscosity or the like, the length of a spray pattern and the like.

The groove may be formed into any suitable sectional configuration such as a V-shape, a U-shape, a W-shape, an inverted trapezoid shape or the like. The bottom of the groove is positioned so as to be aligned with the front end of each of the first auxiliary slants or in proximity thereto. When the groove is formed into a V-shape, a tolerance of the distance between the bottom of the groove and the front end of each first auxiliary slant is from one hundredth to one tenth as large as the dimension between both ends of the injection port. When the groove is formed into a U-shape, it is within one hundredth as large as the dimension between both ends of the injection port.

In the present invention constructed as described above, the first auxiliary slants are arranged on the inner surface of the nozzle body so as to be positioned between the front ends of the main slants and both ends of the injection port and the second auxiliary slants are arranged on the inner surface of the front nozzle section in a manner to be contiguous to the first auxiliary slants and at an inclination angle larger than that of the first auxiliary slants. The first auxiliary slants are arranged so as to cause an angular corner of a predetermined length to be formed between each of the first auxiliary slants and each of the main slants and slantingly formed so as to slope forwardly and gradually approach the axis of the nozzle body. The so-formed angular corner of a length permits fluid linearly or straightly flowing along the main slants to be varied to produce significant turbulence. Also, the arrangement of the first auxiliary slants cause the front ends thereof to be positioned in proximity to the axis of the nozzle body as compared with the front ends of the main slants, to thereby cause both ends of the injection port to be positioned in proximity to or approach the center or axis of the nozzle at which the velocity of paint is increased. This permits paint to be satisfactorily sprayed under a relatively low pressure while preventing generation of tailing. It would be considered that an increase in inclination angle of the main slants causes both ends of the injection port to approach the axis of the nozzle without providing the first auxiliary slants. Unfortunately, such arrangement fails to provide such an angular corner as formed between the first auxiliary slants and the main slants, to thereby fail to form turbulence. Thus, this does not prevent generation of tailing when point is sprayed under a low pressure.

A pair of the second auxiliary slants are formed so as to incline at an angle larger than the inclination angle of the first auxiliary slants, to thereby provide an acceleration region of a predetermined range at the front of both ends of the injection port. The second auxiliary slants cause the inner surface of the nozzle body positioned at both ends of the injection port to approach the axis of the nozzle, to thereby increase the velocity of paint near the ends of the injection port. Such a function of the second auxiliary slants is enhanced as the viscosity of paint increases. However, when the length of the second auxiliary slants in the axial direction of the nozzle is excessive, the nozzle fails to excellently form an elongated spray pattern; therefore, it is preferable to limit the length to a predetermined range.

In the present invention, a pair of the steps, a pair of the main slants, and each pair of the first and second auxiliary slants cooperate to each other to permit paint of high viscosity to be satisfactorily sprayed under a relatively low pressure while preventing generation of tailing.

Further, in the present invention, so long as the front end of each of the first auxiliary slants is formed into a predetermined length, the dimension between the bottom of the groove and the front end of each of the first auxiliary slants can be within a predetermined tolerance even when the groove is deviated somewhat from the center of the nozzle body, resulting in increasing the yields.

Moreover, when the present invention is constructed that the first and second auxiliary slants each are arranged to be symmetric about the axis of the depression, the length of the injection port can be substantially constant even when the groove is formed while being positionally deviated to a certain degree, so that a spray pattern may be kept substantially uniform.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, an airless spray nozzle according to the present invention will be described hereinafter with reference to the accompanying drawings.

Figure 1:
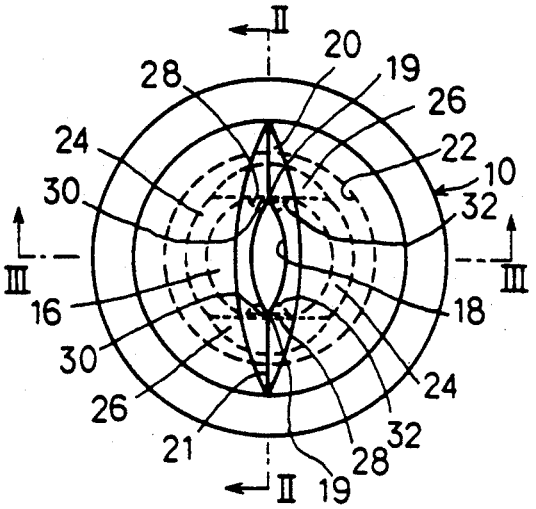
FIG. 1 is a plan view showing an embodiment of an airless spray nozzle according to the present invention.
Figure 2:
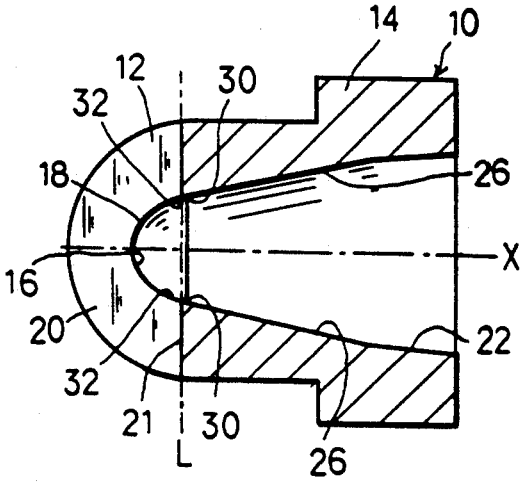
FIG. 2 is a sectional view taken along line II—II of FIG. 1.
Figure 3:
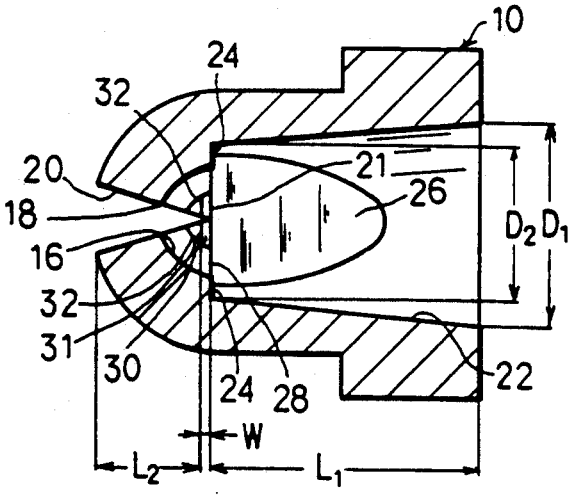
FIG. 3 is a sectional view taken along line III—III of FIG. 1.

FIGS. 1 to 3 show an embodiment of an airless spray nozzle according to the present invention. An airless spray nozzle of the illustrated embodiment includes a nozzle body 10, which may be integrally made of a super hard material such as sintered hard alloy, ceramic or the like. The nozzle body 10 includes a front nozzle section 12 and a rear nozzle section 14. The front nozzle section 12 is provided therein with a depression 16 having a dome-like or substantially hemi-spherical shape and an axis X, which depression 16 is formed with its surface opening rearwardly. Also, the front nozzle section 12 is formed at the front end portion thereof with a transverse groove 20 so as to intersect the depression 16, so that a lip-like or lenticular orifice-type injection hole or port 18 is provided at the front end of the front nozzle section. In the illustrated embodiment, the groove 20, as shown in FIG. 3, is formed with outwardly diverging walls to be V-shaped in section in a direction perpendicular to the longitudinal direction thereof.

Figure 4:
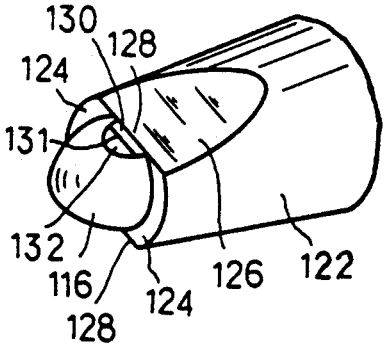
FIG. 4 is a perspective view showing an example of a core suitable for use for manufacturing the airless spray nozzle shown in FIG. 1.

The rear nozzle section 14 is formed therein with a through-hole 22 so as to communicate with the depression 16. The through-hole 22 is arranged so as to be coaxial with the depression 16. More particularly, it has an axis common to or aligned with the axis X of the depression 16. Also, the through-hole 22 is formed into a shape having a forwardly converging wall. The configuration of each of the through-hole 22 and depression 16 will be more clearly understood with reference to FIG. 4 as well as FIG. 13. FIG. 4 shows a core used for shaping the nozzle of the illustrated embodiment. In order to help understanding of the core, parts of the core corresponding to the above-described parts of the nozzle are designated by reference numerals of three digits wherein a number "1" is assigned in front of each of the reference numerals designating the parts of the nozzle described above with reference to FIGS. 1 to 3.

At the boundary between the through-hole 22 of the rear nozzle section 14 and the depression 16 of the front nozzle section 12 in the nozzle body 10 are formed a pair of steps 24 in a manner to be opposite to each other. The steps 24 each are arranged so as to extend laterally outward of the depression 16 in a direction substantially perpendicular to a line L (see FIG. 2) defined by connecting both ends 19 of the orifice-type injection port 18, as shown in FIGS. 1 and 3. In the illustrated embodiment, the steps 24 each are formed into a substantially arcuate shape as shown in FIG. 1. The rear nozzle section 14 is connected through the rear end of through-hole 22 to a paint food source (not shown) using a suitable connection means. Alternatively, the rear nozzle section 14 may be formed into an increased length so as to axially extend the through-hole 22 to a degree sufficient to permit the rear nozzle section 14 to be directly connected to paint feed source through the rear end of the through-hole 22.

The inner surface of the rear nozzle section 14 defining the through hole 22 is formed with a pair of main slants 26 opposite to each other in a manner to be positioned on both end sides 19 of the orifice-type injection port 18 or in a manner to be positionally interposed between the steps 24. The main slants 26 are provided so as to slope forwardly toward the axis of the nozzle body 10.

The inner surface of the front nozzle section 12 of the nozzle body 10 is formed on the portion thereof defining the depression 16 with a pair of first auxiliary slants 30 in a manner to be opposite to each other and contiguous to the main slants 26. The first auxiliary slants 30 each are arranged so as to laterally extend in opposite directions at each end of the orifice-type injection port 18 and slope forward gradually toward the axis X of the nozzle body 10. The first auxiliary slants 30 are arranged at the portion of the inner surface of the nozzle body 10 between the front ends 28 of the main slants 26 and the ends 19 of the orifice-type injection port 18. Therefore, in the illustrated embodiment, the first auxiliary slants 30 are formed on the inner surface of the front nozzle section 12, however, they may be arranged on the inner surface of the nozzle body extending over both the front nozzle section 12 and rear nozzle section 14. Also, the inclination angle of each of the first auxiliary slants 30 defined in the axial direction of the nozzle body 10 is determined so as to be larger than the inclination angle of the main slants defined in the same manner. Further, the inner surface of the front nozzle section 12 of the nozzle body is formed on the portion thereof defining the depression 16 with a pair of second auxiliary slants 32 in a manner to be positioned forward of the first auxiliary slants 30 and contiguous to thereto. Also, the second auxiliary slants 32 each are arranged so as to extend in opposite directions at each end 19 of the orifice-type injection port 18 and slope forward gradually toward the axis X of the nozzle body 10. Thus, the first auxiliary slants 30 are provided between the main slants 26 and the second auxiliary slants 32 in a manner to be aligned therewith and contiguous thereto in the axial direction of the nozzle body 10. The inclination angle of the first auxiliary slants 30 defined in the axial direction of the nozzle body may be varied depending upon the inclination angle of the main slants 26. For example, the inclination angle of the first auxiliary slants 30 is preferably set within the range between two degrees and twenty degrees when that of the main slants is set within the range between one degree and sixty degrees. It is not necessarily required to render the inclination angle of the first auxiliary slants 30 large as compared with that of the main slants 26. It is merely required to set the inclination angle of the first auxiliary slants 30 so that an angular corner may be defined between each of the first auxiliary slants 30 and the main slant 26 corresponding thereto at the front end 28 of each of the main slants 26.

The inclination angle of the second auxiliary slants 32 is set to be larger than that of the first auxiliary slants 30. The inclination angle of the second auxiliary slants 32 is preferably set within the range between 3 degrees and 30 degrees. The inclination angle is preferably increased with an increase in viscosity of paint to be sprayed.

The groove 20 is so formed that the distance between the front end of each of the first auxiliary slants 30 and the bottom 21 of the groove 20 is within a predetermined range. The groove 20 may be formed using a suitable grinding means such as a diamond grinding wheel or the like and the sectional configuration of the groove may depend upon the sectional configuration of a grinding means used.

Figure 5:
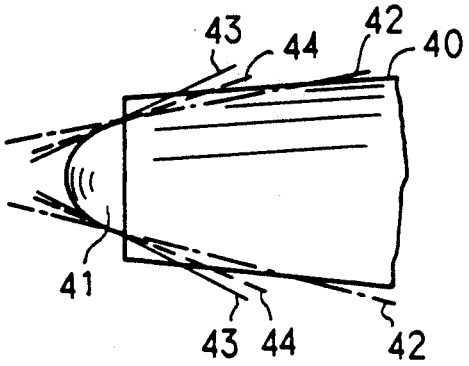
FIG. 5 is a schematic view showing the manner of manufacturing of the core shown in FIG. 4.
Figure 6:
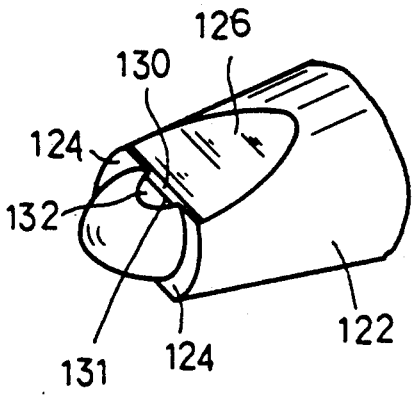
FIG. 6 is a perspective view showing a core suitable for use for manufacturing another embodiment of an airless spray nozzle according to the present invention.
Figure 7:
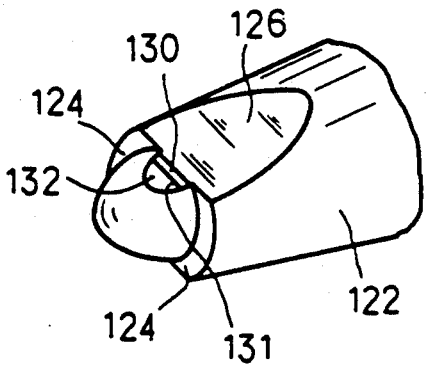
FIG. 7 is a perspective view showing a core suitable for use for manufacturing a further embodiment of an airless spray nozzle according to the present invention.

For manufacturing the core shown in FIG. 4, a core blank which may be formed of a super hard material so as to include a frust-conical section 40 and a hemispherical section 41 is prepared as shown in FIG. 5. Then, the core blank is cut along cut planes 42, resulting in slants 126 being formed. Subsequently, the core blank is cut along cut planes 43 to form surfaces including slants 132. Thereafter, the core blank is cut along cut planes 44 to form slants 130. A variation in inclination angle of the cut surfaces causes the position and width of the slants 130 and 132 and the width of a step 124 to be varied as desired. FIGS. 6 and 7 each exemplify a core wherein the inclination angle of the cut planes or the cut angle is varied. The airless spray nozzle of the present invention may be manufactured using the core shown in FIGS. 6 or 7.

Figure 8:
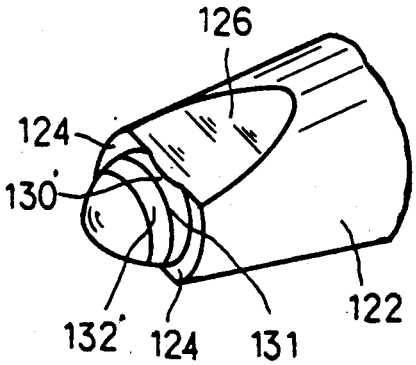
FIG. 8 is a perspective view showing a core suitable for use for manufacturing still another embodiment of an airless spray nozzle according to the present invention.

Alternatively, the core, as shown in FIG. 8, may be manufactured by successively cutting the outer periphery of the base portion of the hemi-spherical section 41 (FIG. 5) in the circumferential direction and then subjecting it to cutting to form the slants 130 and 132. Such procedure facilitates formation of the auxiliary slants because the cutting of the blank in the circumferential direction may be readily accomplished.

The airless spray nozzle of the illustrated embodiment may be formed by forming a blank for the nozzle body using the above-described core, a cylindrical outer mold, and upper and lower molds arranged in the vertical direction of the outer mold and then sintering the blank.

In the illustrated embodiment, the steps 24 are formed so as to be flat, however, they may be formed into any other suitable shape so long as they permit desired turbulence to be effectively formed in the nozzle.

Now, the present invention will be further described in connection with an experiment which was made by the inventor.

Experiment

Figure 9A:
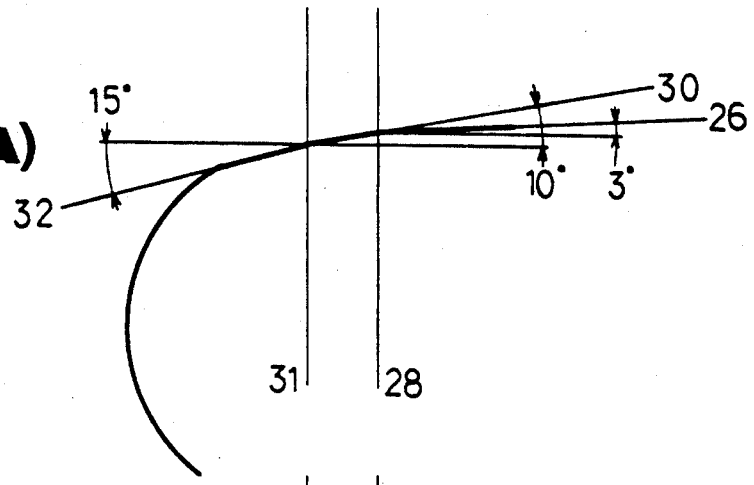
FIGS. 9A to 9C each are a diagrammatic view showing an inclination angle of each of slants defined in an airless spray nozzles according to the present invention.
Figure 9B:
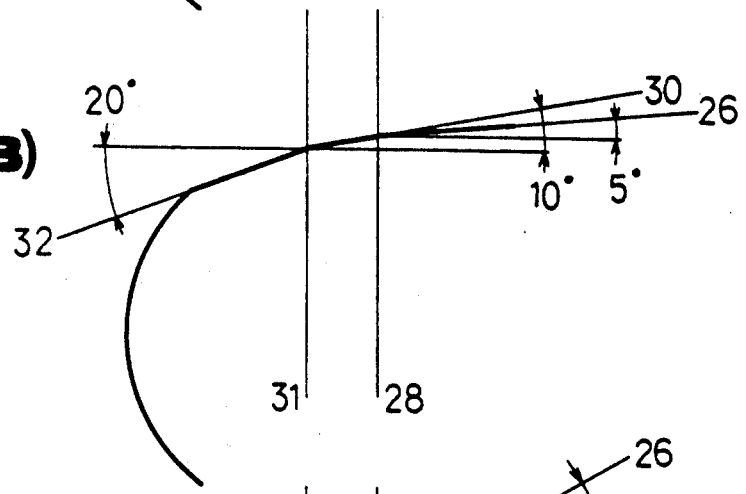
Figure 9C:
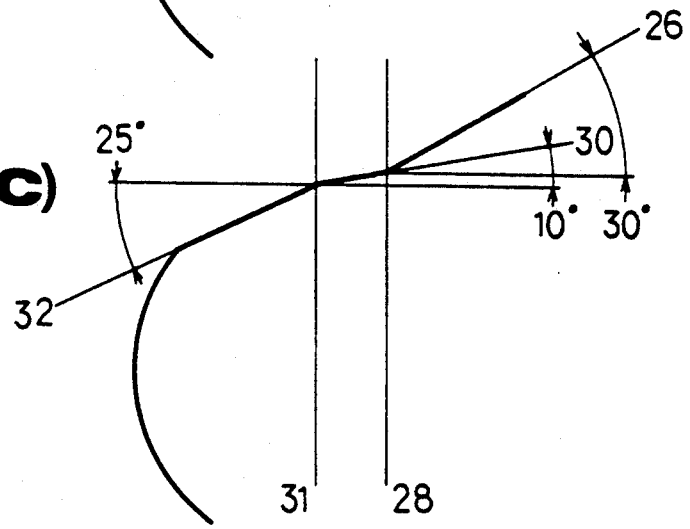

An experiment took place for confirming the function of the airless spray nozzle of the present invention. For this purpose, three airless spray nozzle A, B and C constructed in accordance with the present invention were used which have inclination angles shown in FIGS. 9A, 9B and 9C, respectively. Lines designated at reference numerals 26, 30 and 32 in FIGS. 9A, 9B and 9C correspond to the main slants 26, first auxiliary slants 30 and second auxiliary slants 32, respectively, and lines 28 and 31 correspond to the ends 28 and 31, respectively.

For comparison, two conventional nozzles D and E were manufactured according to the teachings of U.S. Pat. No. 4,905,911 and U.S. Pat. No. 3,659,787, respectively, and then tested. The nozzle D is constructed in a manner to be free of the first and second auxiliary slants, so that the groove extends at the bottom thereof beyond the front end of each of the main slants.

Conditions for the experiment were as follows:

Paint used: Latex paint manufactured and sold by Kansai Paint Kabushiki Kaisha, Japan (special acrylic resin paint) (JIS-K-5663, Code Number: 391-021)

Viscosity of Paint: 20, 30 and 45 poise
Temperature of Paint: 21° C.
Injection Pressure: 55 to 80 kg/cm$^2$
Spraying Distance: 300 mm

Dimensions of Nozzle

Overall Length: 2.6 mm
Maximum Diameter D1 of Through-hole 22: 1.8 mm
Mininum Diameter D2 of Through-hole 22: 1.3 mm
Length L1 of Through-hole 22: 1.3 mm
Width W of Auxiliary Slants 30: 0.2 mm
(This dimension is for only Nozzle A)
Width of Steps 24: 0.97 mm
Height of Steps 24: 0.2 mm
Maximum Diameter of Depression 16: 0.9 mm
Sectional Configuration of Groove 20: V-shape
Angle of Opening of Groove 20: 55.5 degrees
Depth L2 of Groove 22: 1.1 mm
Dimension of Intersection between Groove 20 and Front End 31: 0.01 mm
Maximum Width of Injection Port: 0.47 mm Spray tests were carried out under the above-described conditions while varying viscosity of paint and a injection pressure under which the paint is sprayed, resulting in determining generation of tailing. The results were as shown in Tables 1 to 3, wherein x indicates that tailing was produced and o indicates that no tailing was produced. The paint used is water-soluble, therefore, the viscosity was varied by varying the amount of water to be added to the paint.

TABLE 1

| | (Viscosity: 20 poise) | | | | |
|---|---|---|---|---|---|
| | Injection Pressure (kg/cm$^2$) | | | | |
| Nozzle Tested | 55 | 60 | 65 | 70 | 80 |
| Nozzle A | x | x | x | o | o |
| Nozzle B | x | o | o | o | o |
| Nozzle C | x | o | o | o | o |
| Nozzle D | x | x | x | x | o |
| Nozzle E | x | x | x | x | x |

TABLE 2

| | (Viscosity: 30 poise) | | | | |
|---|---|---|---|---|---|
| | Injection Pressure (kg/cm$^2$) | | | | |
| Nozzle Tested | 55 | 60 | 65 | 70 | 80 |
| Nozzle A | x | x | x | o | o |
| Nozzle B | x | x | o | o | o |
| Nozzle C | x | o | o | o | o |
| Nozzle D | x | x | x | x | o |
| Nozzle E | x | x | x | x | x |

TABLE 3

| | (Viscosity: 45 poise) | | | | |
|---|---|---|---|---|---|
| | Injection Pressure (kg/cm$^2$) | | | | |
| Nozzle Tested | 55 | 60 | 65 | 70 | 80 |
| Nozzle A | x | x | x | x | o |
| Nozzle B | x | x | x | o | o |
| Nozzle C | x | x | o | o | o |
| Nozzle D | x | x | x | x | x |
| Nozzle E | x | x | x | x | x |

As will be noted from the results shown in Tables 1 to 3, the first and second auxiliary slants exhibit a significant advantage of effectively preventing generation of tailing. The comparison between the nozzle A and the nozzle B and that between the nozzle B and the nozzle C indicate the inclination angle of the main slants 26 is not very essential. Rather, the inclination angle of the second auxiliary slants effectively contributes to the prevention of generation of tailing which tends to be increased with an increase in viscosity of paint. Also, the comparison between the nozzle A and the nozzle D reveals that the first auxiliary slants contribute to the lowering of the injection pressure.

Further, the results indicate that the main slants, first auxiliary slants and second auxiliary slants cooperate with each other for preventing generation of tailing.

As can be seen from the foregoing, in the present invention, a pair of the sleps, a pair of main slants, a pair of first auxiliary slants and a pair of the second auxiliary slants cooperate to one another with positively spray paint of increased viscosity under a relatively low pressure without generating any tailing.

Also, in the present invention, so long as the front end of each of the first auxiliary slants is formed into a predetermined length, the dimension between the bottom of the groove and the front end of each of the first auxiliary slants can be within a predetermined tolerance even when the groove is deviated somewhat from the center of the nozzle body, resulting in increasing the yields.

Further, the present invention may be so constructed that the first and second auxiliary slants each may be arranged to be symmetric about the axis of the depression. Such construction permits the length of the injection port to be substantially constant even when the groove is formed while being positionally deviated to a certain degree, so that a spray pattern may be kept substantially uniform.

While a preferred embodiment of the present invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An airless spray nozzle comprising:

a front nozzle section having a substantially hemispherical depression having an inner surface open to the rear and having a front portion with a transverse groove intersecting said depression to form a lenticular orifice-type injection port;

a rear nozzle section formed integral with said front nozzle section and provided therein with a through-hole in a manner to be coaxial with said depression and communicating with said depression;

a pair of steps arranged at the boundary between said through-hole of said rear nozzle section and said depression of said front nozzle section opposite to each other;

said steps each being arranged so as to extend in a radial direction outward of said depression, said radial direction being substantially perpendicular to a line defined by connecting both ends of said injection port;

a pair of main slants formed on the inner surface of said rear nozzle section defining said through-hole, said slants being opposite to each other and positioned on both ends of said orifice-type injection port;

said main slants being arranged so as to slope forwardly toward the axis of said through-hole;

a pair of first auxiliary slants formed on said inner surface of said depression opposite to each other and contiguous to said main slants;

said first auxiliary slants each being slantingly arranged so as to slope forwardly toward the axis of said depression at an inclination angle different from that of said main slants; and a pair of second auxiliary slants formed on said inner surface of said depression forward of said first auxiliary slants and contiguous thereto;

said second auxiliary slants each being slantingly arranged so as to slope forwardly toward the axis of said depression at an inclination angle larger than that of said first auxiliary slants;

said groove having a bottom arranged in a manner to be aligned in proximity with the front end of each of said first auxiliary slants.

2. An airless spray nozzle as defined in claim 1, wherein each of said first auxiliary slants has a front end formed into a predetermined length.

3. An airless spray nozzle as defined in claim 1, wherein said first and second auxiliary slants each are arranged to be symmetric about said axis of said depression.

4. A spray nozzle for use for airless spraying apparatus which is adapted to spray paint by means of only a liquid pressure, comprising:

a nozzle body having a front portion with a substantially V-shaped groove to define a lenticular orifice-type injection port having opposite ends and provided therein with a flow passage of which one end communicates with said groove and the other end is connected to a paint feed source;

said flow passage including a substantially hemispherical depression opening to the rear and intersecting said groove to form said lenticular orifice-type injection port and a through-hole arranged in a manner to be coaxial with said depression and communicate with said depression and connected to said paint feed source;

said depression and said through-hole defining an inner surface;

a pair of steps arranged at the boundary between said through-hole and said depression to be opposite to each other;

said steps each being arranged so as to symmetrically extend in a radial direction outward of said depression, said radial direction being perpendicular to a line defined by connecting said ends of said injection port;

a pair of main slants formed on the inner surface of said nozzle body defining said through-hole in a manner to be opposite to each other and positioned on both of said ends of said orifice-type injection port;

said main slants being arranged so as to slope forwardly toward the axis of said through-hole;

a pair of first auxiliary slants formed on said inner surface of said nozzle body to be opposite to each other and contiguous to said main slants;

said first auxiliary slants each being slantingly arranged so as to slope forwardly toward the axis of said depression at an inclination angle different from that of said main slants; and a pair of second auxiliary slants formed to be positioned forward of said first auxiliary slants and contiguous thereto;

said second auxiliary slants each being slantingly arranged so as to slope forwardly toward the axis of said depression at an inclination angle larger than that of said first auxiliary slants.

* * * * *